United States Patent [19]

Myers

[11] Patent Number: 4,873,470

[45] Date of Patent: Oct. 10, 1989

[54] PROGRAMMABLE ULTRAVIOLET LAMP CONTROL SYSTEM

[75] Inventor: Robert A. Myers, Viroqua, Wis.

[73] Assignee: NCR Corporation, Dayton, Ohio

[21] Appl. No.: 199,987

[22] Filed: May 27, 1988

[51] Int. Cl.[4] ..... H05B 41/14

[52] U.S. Cl. ..... 315/240; 315/76

[58] Field of Search ..... 315/76, 107, 226, 240

[56] References Cited

U.S. PATENT DOCUMENTS

| | | | |
|---|---|---|---|
| 3,984,726 | 10/1976 | Ramler | 315/107 |
| 4,005,135 | 1/1977 | Helding | 250/527 |
| 4,097,783 | 6/1978 | Hathaway | 315/240 X |
| 4,220,865 | 9/1980 | Silverman | 250/504 |
| 4,495,713 | 1/1985 | Williner | 34/68 |
| 4,665,627 | 5/1987 | Wilde et al. | 34/4 |

*Primary Examiner*—David Mis

*Attorney, Agent, or Firm*—Wibert Hawk, Jr.; Albert L. Sessler, Jr.; George J. Muckenthaler

[57] ABSTRACT

A variable intensity, ultraviolet lamp is used in a drying process. The ultraviolet lamp provides a low level intensity for use during a low intensity portion of the drying or curing cycle and provides a high level intensty for use during an increased or a maximum intensity portion of the cycle. Capacitors are switched into and out of a circuit which also includes a ballast transformer of the lamp for enabling variable intensity levels for use in the drying of printing ink on business forms or like media.

6 Claims, 3 Drawing Sheets

PROGRAMMABLE ULTRAVIOLET LAMP CONTROL SYSTEM

BACKGROUND OF THE INVENTION

In the field of ultraviolet curing systems, the ultraviolet lamps generate large quantities of heat. This generated heat is a by-product of and is unwanted in the manufacture of business forms. A high intensity curing system provides for rapid drying of the ink. However, the high intensity system uses a large amount of power and also shortens lamp life due to high temperature. Additionally, the high intensity system causes overheating of the paper or other record media which carries the printing ink.

A number of ways for controlling the heat in ultraviolet curing systems have been recommended. A popular method of controlling the heat is by providing cooling in the system. The cooling of ultraviolet curing systems has been accomplished by high volume purging of the air in the vicinity of the ultraviolet lamps, by use of infrared filters between the lamps and the record media, by the use of heat sinks along the path of the record media, and by use of water-cooled lamp reflectors.

It is important to provide a curing system that deals with high production output while realizing maximum efficiency of the costs of operation.

Representative documentation in the area of ultraviolet lamp control includes U.S. Pat. No. 3,984,726, issued to W. J. Ramler on October 5, 1976, which discloses ultraviolet light processors containing a plurality of ultraviolet light sources wherein the processors are improved by providing means for increasing the intensity of one lamp to compensate for a reduction in intensity of another lamp so that the total intensity of the system is substantially the same.

U.S. Pat. No. 4,005,135, issued to N. A. Helding on Jan. 25, 1977, discloses an ultraviolet curing lamp system having rotatable reflector assemblies and wherein the lamp power is reduced at the time the reflector assemblies are rotated.

U.S. Pat. No. 4,220,865, issued to S. Silverman on Sept. 2, 1980, discloses an ultraviolet curing oven wherein air flow paths are provided to cool the lamps and reflectors during high power operation and to enable the lamp to stay hot during low power operation.

U.S. Pat. No. 4,495,713, issued to M. Williner on Jan. 29, 1985, discloses infrared radiation devices wherein energy is saved during drying of film if the power is automatically varied in accordance with temperature measurements taken on circulating air.

And, U.S. Pat. No. 4,665,627, issued to H. J. Wilde on May 19, 1987, discloses ultraviolet lamps which are controlled by a circuit that regulates the intensity of the lamps to a set level as the lamps age. A sensor provides a signal that is directly proportional to ultraviolet light intensity and this signal is used to adjust the power to the lamps through a microprocessor controlled power source to maintain the UV intensity at the set level.

SUMMARY OF THE INVENTION

The present invention is directed to an improved control system for ultraviolet lamps. The ultraviolet lamps are used in a curing process or system for drying printing ink. The printing ink is used in the manufacture and production of business forms and labels wherein a high intensity lamp output is necessary to cure the ink in each curing system.

An ultraviolet lamp is connected to a power source and a control circuit is provided to vary the intensity of the lamp in an ultraviolet curing unit or system. The control circuit includes a 12 volt D.C. supply, a plurality of solid state relays and a plurality of capacitors. A programmable controller or a solid state cam switch is used to regulate the ultraviolet lamp ballast system.

A high voltage circuit includes a plurality of ballast capacitors and a plurality of solid state relays. The control circuit is designed and provided for the purpose of controlling the time interval that the lamp is operating either at a low intensity level or at a high intensity level in a curing cycle. During the low intensity portion of the curing cycle the lamp operates at approximately 20% of rated power to remain at operating temperature. During the high intensity portion of the curing cycle, additional capacitors are switched into the circuit to obtain the ultraviolet power required for curing the ink in a production run of the curing unit.

In view of the above discussion, a principal object of the present invention is to provide an improved control system for an ultraviolet lamp in a curing unit.

Another object of the present invention is to provide a variable intensity ultraviolet curing process that enables the production of printed business forms which requires an increased intensity of ultraviolet light to cure the printing ink.

An additional object of the present invention is to provide a variable intensity ultraviolet curing system which operates at low intensity during a portion of the curing cycle and which conserves power and extends lamp life.

A further object of the present invention is to provide a variable intensity ultraviolet curing system that eliminates overheating of the paper web.

Still another object of the present invention is to provide an improved control system for an ultraviolet lamp in a curing unit to prevent heat build-up and to conserve power.

Additional advantages and features of the present invention will become apparent and fully understood from a reading of the following description taken together with the annexed drawing.

DESCRIPTION OF THE PREFERRED EMBODIMENT

Figure 1:
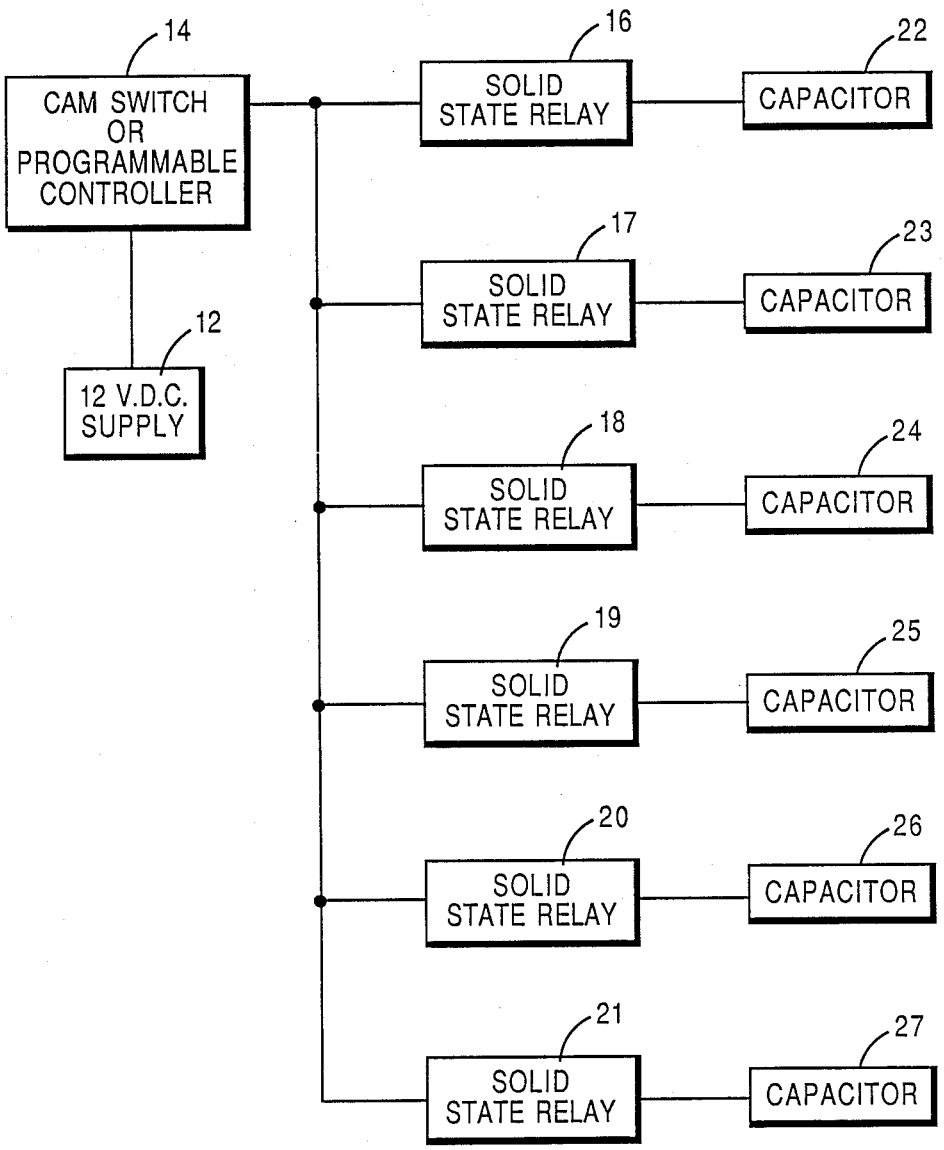
FIG. 1 is a block diagram of the essential components of the control voltage circuitry of the ultraviolet curing system of the present invention.

Prior to discussing the several figures of the drawing, it should be noted that a curing unit is one part of a press operation wherein one or more webs of paper are transported along a process line. The curing unit includes an ultraviolet lamp that is positioned adjacent the web of paper for the purpose of curing the printing ink that has been placed on the paper during the press operation. An ultraviolet lamp is defined as a lamp providing a high proportion of ultraviolet radiation. The ultraviolet pertains to electromagnetic radiations at wavelengths beyond the violet end of the spectrum of visible radiation.

The ultraviolet lamp includes a ballast transformer and a pair of lamp terminals and the radiation is generated when an arc is present inside the lamp. The intensity of the lamp or the ultraviolet radiation therefrom is controlled or adjusted by a plurality of capacitors which act as lamp ballast or reserve current in the system.

When the press line is running, the curing unit is operating and the lamp is providing high intensity output to cure the printing ink on the web of paper. The lamp provides both ultraviolet and infrared outputs. The generated frequencies of the infrared are a by-product of the operation and cannot be avoided since the ratio of the ultraviolet and the infrared outputs remains constant throughout the various power levels.

The control system of the present invention provides for control or adjustment of the time interval that the lamp is operating at maximum output or intensity.

Referring now to the drawing, FIG. 1 is a block diagram showing the essential parts of the control voltage circuit used in the system. A 12 volt DC supply 12 is connected to a cam switch 14 in turn connected to a plurality of solid state relays 16, 17, 18, 19, 20 and 21. The relays 16–21 are connected to associated capacitors 22, 23, 24, 25, 26 and 27. The cam switch 14 operates as a programmable controller in the control voltage circuit.

Figure 2:
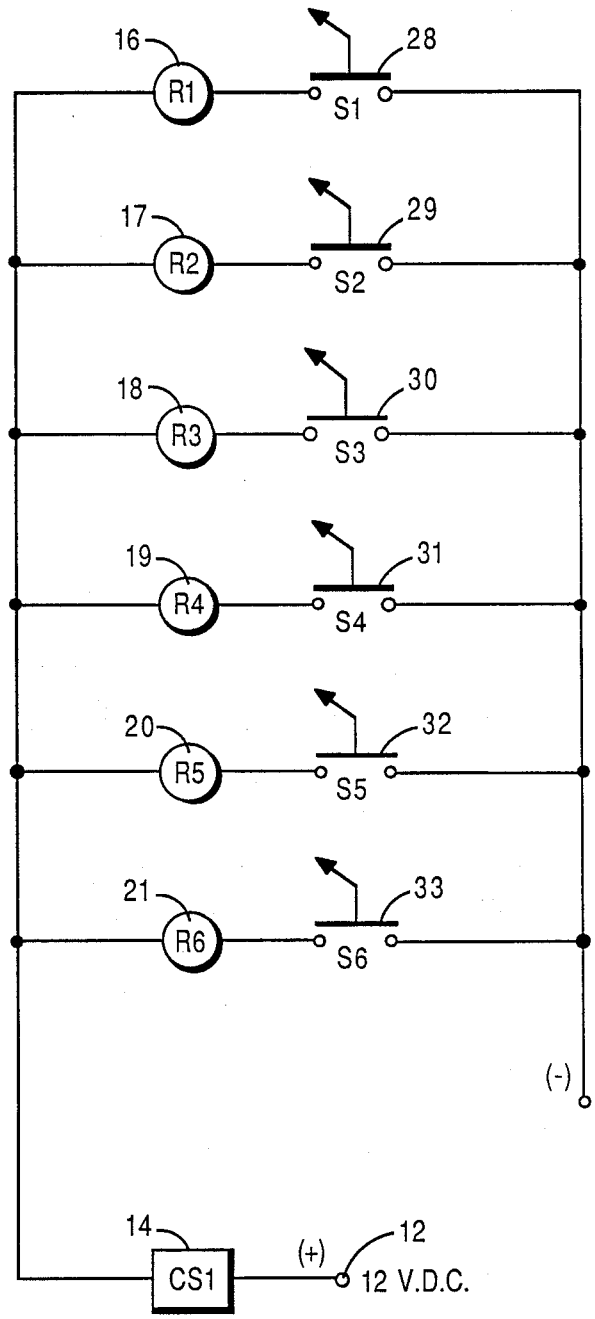
FIG. 2 is a diagram of the control circuits for the variable intensity ultraviolet curing unit.

FIG. 2 is a diagram of the control circuits and includes the 12 volt DC supply 12 and the cam switch 14, designated as CS1. This diagram shows the six solid state relays as including the respective coils 16- 21. The relay coils 16-21, designated as R1–R6, are connected to a plurality of control switches 28, 29, 30, 31, 32 and 33 designated as S1-S6, and indicated as manually-operated toggle switches.

Figure 3:
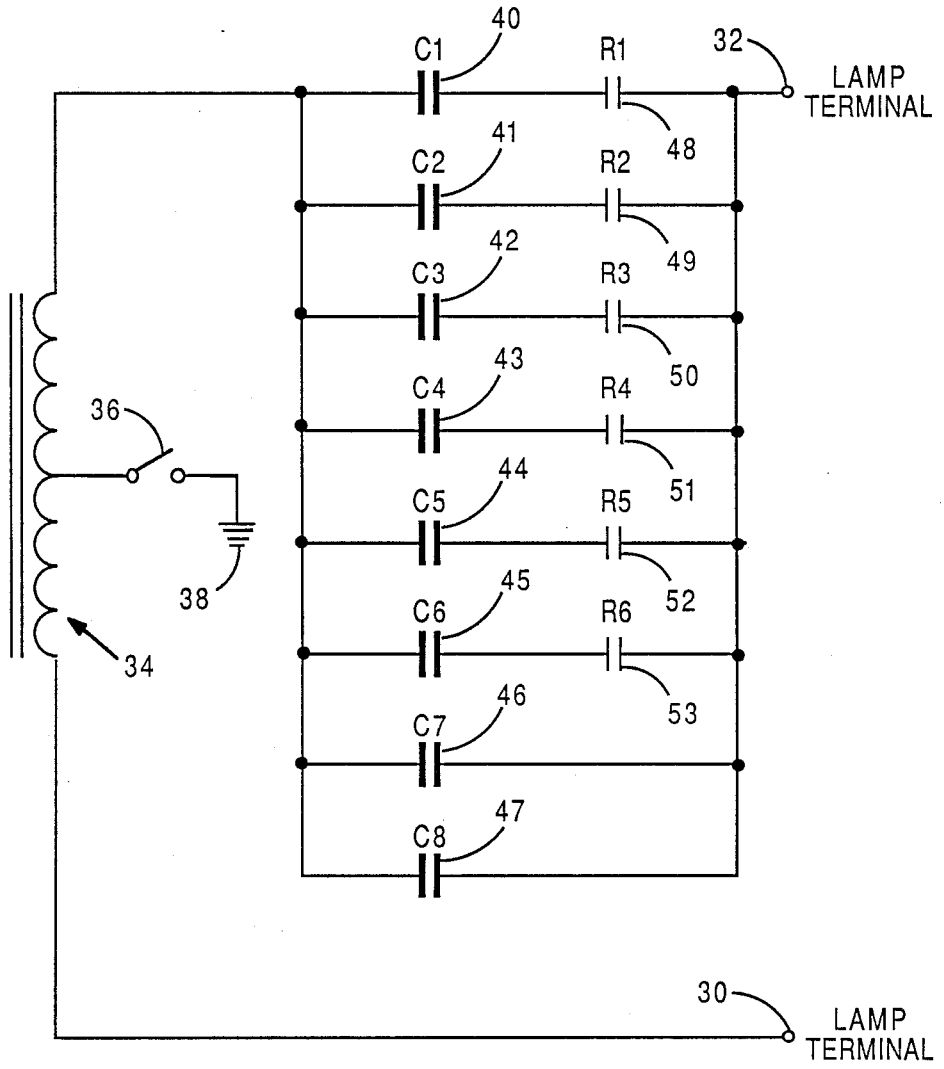
FIG. 3 is a diagram of the high voltage or power circuit for the variable intensity ultraviolet curing unit.

FIG. 3 is a diagram of the high voltage or power circuit and includes lamp terminals 30 and 32 along with a lamp ballast transformer 34 which is connected through a disconnect switch 36 to ground 38. One side of the lamp ballast transformer 34 is connected to a plurality of ballast capacitors 40–47. Capacitors 40–45, designated as C1–C6, are connected to contacts 48–53, respectively, of the solid state relays, designated as R1–R6. Capacitors 46 and 47, designated as C7 and C8, are connected directly from one side of the ballast transformer 34 to the lamp terminal 32 and are required in the circuit to maintain a minimum lamp temperature. The ballast transformer 34 supplies current to the capacitors C1–C8 and to the lamp.

In the practice of the invention, the lamp intensity is varied by use of the several components shown and described herein which components are added to an existing ultraviolet curing unit. A programmable controller or the cam switch 14 is used to regulate the lamp system.

The total amount of lamp power required for the curing unit during the high or full intensity portion of the curing cycle is predetermined and the number of capacitors is provided in the circuit for such portion of the cycle. The adjustable cam switch or programmable controller 14 allows a precise timing of the "with the web" dimension of the curing cycle. It is calculated that a five (5) watt per inch increase in lamp output requires an additional one (1) microfarad of capacitance in the lamp ballast circuit. A capacitor requires only a maximum of two (2) cycles to fully charge when it is switched into a circuit. The two cycles equate to one-thirtieth (1/30) second which does not affect the speed of the press.

During the low or "off intensity" portion of the curing cycle, the lamp operates at 20% of rated power to remain at or to maintain operating temperature.

When it is desired to increase the lamp intensity or output, one or more of the switches 28–33, designated as S1–S6, in accordance with the lamp intensity required, are turned on to energize corresponding ones of the relays 16–21 in the circuit. The curing circuit is thus operated at low level during the "off intensity" portion of the cycle, and the intensity can be varied in steps by operation of the switches 28–33, to a maximum level by switching in additional capacitors into the circuit. The various elements used in the practice of the invention, including the solid state relays 16–21, the cam switch 14, the toggle switches 28–33, and the capacitors 40–47 are commercially available and readily identifiable by one skilled in the art.

It is thus seen that herein shown and described is a variable intensity ultraviolet drying system for use in a curing unit. The system provides for a variable intensity in lamp output for operating in a range from a low intensity to a high intensity output in the drying of printing ink on business forms or like media. The variable intensity output system can be used in the curing of any ultraviolet-sensitive material such as paint and other finishes outside the printing industry. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

What is claimed is:

1. A variable intensity output arrangement of an ultraviolet lamp system for use in curing printing ink, said arrangement comprising at least one ultraviolet lamp having a pair of terminals and a lamp ballast transformer operational with alternating current, a plurality of capacitors coupled to the lamp ballast transformer, said capacitors being selected to enable varying capacitance into the system and thereby provide selected intensities of output of said ultraviolet lamp, a plurality of relay contactors operably coupled to said capacitors for switching said capacitors into and out of operation, a direct current control voltage supply means, a plurality of relay coils operable to actuate the relay contactors, and control means coupled to said control voltage supply means and to said relay coils for timing operation of the output intensity of the ultraviolet lamp system whereby the lamp ballast is selectively varied from a low intensity output during one portion of operation to a higher intensity output during another portion of a curing cycle of operation.

2. The variable intensity output arrangement of claim 1 including a plurality of control switches operably coupled to said relay coils for selecting a number of capacitors to be used with said lamp system.

3. The variable intensity output arrangement of claim 1 wherein at least one capacitor connected to the lamp ballast transformer is maintained in operation during a low intensity portion of the curing cycle to enable the lamp to operate at a percentage of rated power to remain at operating temperature.

4. The variable intensity output arrangement of claim 2 wherein the relay coils are solid state type and are actuated by said control switches.

5. The variable intensity output arrangement of claim 1 wherein said control means comprises an adjustable cam switch.

6. The variable intensity output arrangement of claim 1 wherein said control means comprises a programmable controller.

* * * * *